United States Patent [19]

Levine et al.

[11] Patent Number: 4,928,954

[45] Date of Patent: May 29, 1990

[54] NOVELTY FIGURE WITH ATTACHMENT MEANS

[75] Inventors: Anthony H. Levine, Tarzana; Eduard A. Jaeger, Encino, both of Calif.

[73] Assignee: Krushed Kritter Kompany of Kalifornia, Inc., Tarzana, Calif.

[21] Appl. No.: 182,426

[22] Filed: Apr. 18, 1988

[51] Int. Cl.[5] ..... A63J 5/00

[52] U.S. Cl. ..... 272/8 N; 272/27 N; 446/353

[58] Field of Search ..... 272/8 N, 8 R, 27 N, 272/27 R, 25; 446/353, 337, 177, 158

[56] References Cited

U.S. PATENT DOCUMENTS

| | | | |
|---|---|---|---|
| 1,846,305 | 3/1924 | Schubert | 272/8 N |
| 2,603,485 | 7/1952 | Countryman | 272/8 N |
| 3,343,835 | 9/1967 | Kaplan | 272/8 N |
| 3,873,086 | 3/1975 | Lee | 272/8 N |
| 4,280,695 | 7/1981 | Stenehjem et al. | 272/8 N |

OTHER PUBLICATIONS

"Playthings", Mar. 1960, vol. 58, No. 3, p. 176.

*Primary Examiner*—Richard E. Chilcot, Jr.
*Attorney, Agent, or Firm*—Lewis Anten

[57] ABSTRACT

A novelty item comprising a plush figure, such as half of a cat, having a flexible band of material attached at one end to the figure and at its other end to a hollow tube. During use, the hollow tube is placed within the trunk of a vehicle, and closed on the band, leaving a portion of the band and plush figure outside of the trunk. This gives the comical appearance that a full animal had been closed in the trunk and squashed.

2 Claims, 2 Drawing Sheets

NOVELTY FIGURE WITH ATTACHMENT MEANS

BACKGROUND

There have been a number of novelty items particularly designed for automobiles, including plush animal figures that are attached to the windows of cars by suction cups. There have also been novelty items consisting of signs physically attached to the rear of a window of a car including signs, such as "Husband in Trunk" which is a comical retort to the signs that typically say "Baby On Board." In association with the "Husband In Trunk" sign an occasional user has been known to have a man's necktie hanging out of the trunk as well.

SUMMARY OF INVENTION

In the present invention a novelty item is described consisting of a half a plush figure, such as half a cat, attached to a wide band of flexible material. The other end of the wide band is attached to a thick object, such as a hollow tube, which serves to prevent the flexible portion from being pulled out of a narrow opening. In use, the wide band is laid over the trunk of a car with the hollow tubing inside the car trunk and the half of the plush animal outside of a trunk. The trunk is then closed on the wide flexible band leaving the half animal figure extending outside of a trunk. The thick hollow tubular member prevents the wide band from being pulled out of the trunk.

OBJECTS OF THE PRESENT INVENTION

It is an object of the present invention to provide an improved novelty device.

It is another object of the present invention to provide an improved novelty device having specific application to vehicles, such as cars and trucks.

These and other objects of the present invention will be evident from a review of the following specification and the accompanying drawings.

DETAILED DESCRIPTION

Figure 1:
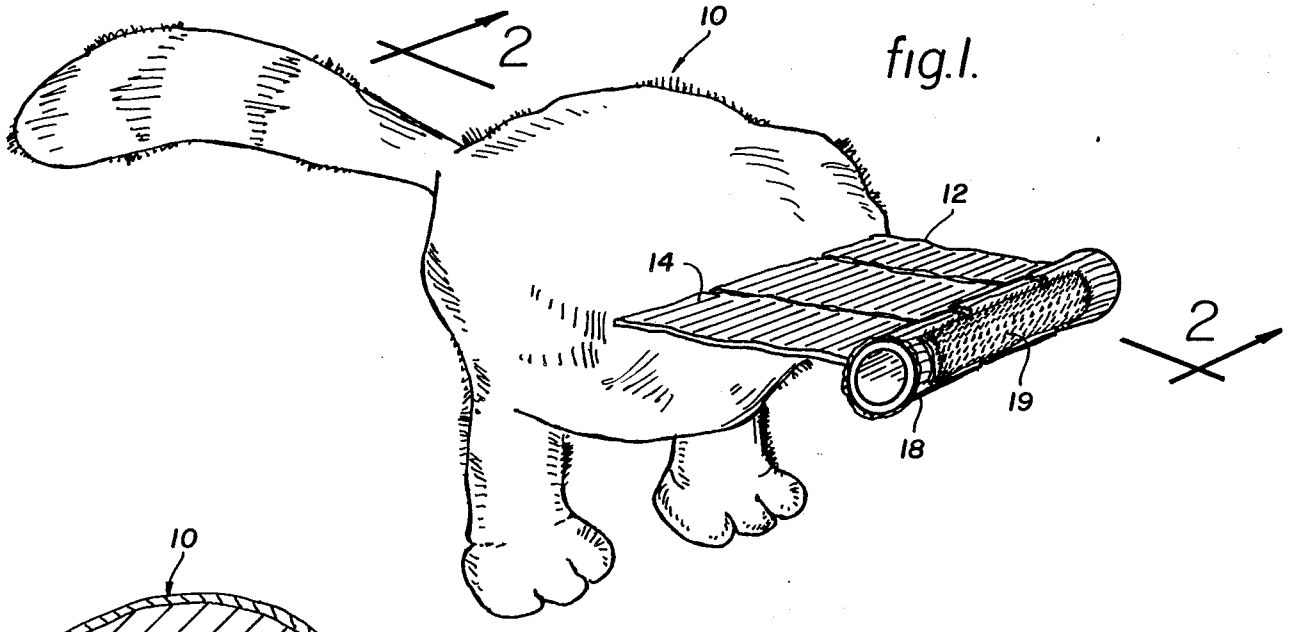
FIG. 1 is a perspective view of the present invention.
Figure 2:
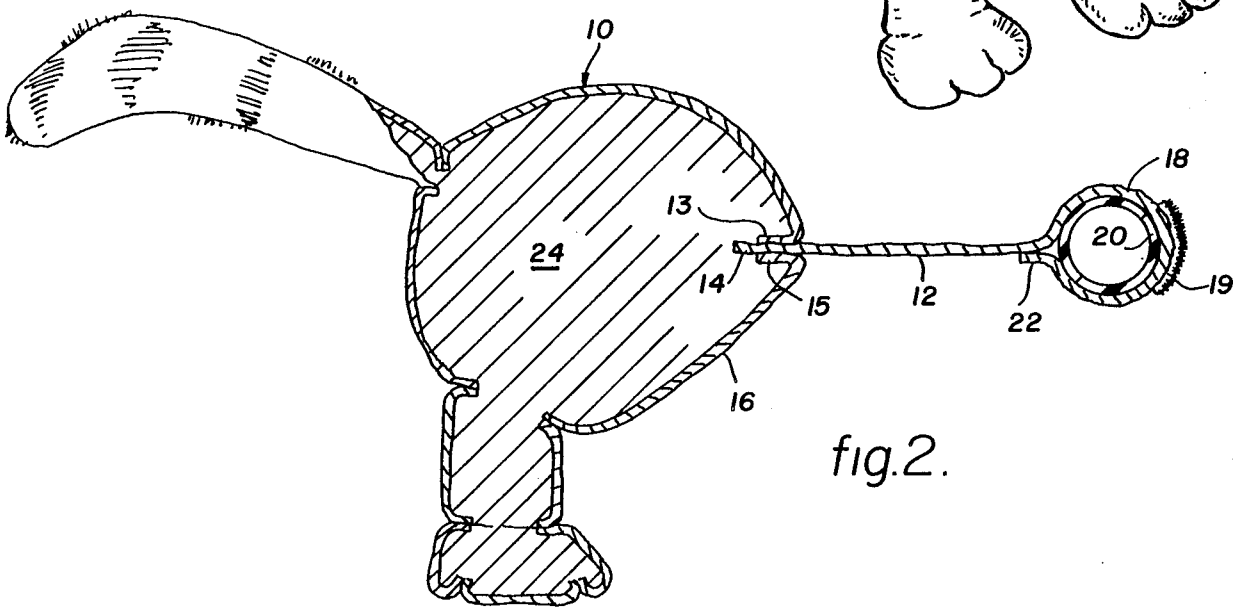
FIG. 2 is a side sectional view of the invention taken along lines 2—2.

A portion of a plus FIG. 10, such as a cat, has a retaining means, such as a thin flexible fabric band 12 attached to the missing half of the FIG. 10. The wide band capable of being stretched 12 is attached by means of sewing one end 14 of the wide band 12 directly to the FIG. 10. The strength of the bond between the band 12 and the figure 10 may be increased by sewing the end 14 of the wide band 12 within folds 13 and 15 of the outer fabric 16 forming the FIG. 10.

The other end 18 of the wide flexible band 12 is wrapped around a thick restraining means, such as a hollow tubular member 20 and then sewn back on itself at 22. The hollow tubular member 20 may be removable, and the end 18 of the wide band 12 having a hook and loop Velcro 19 attachment, for removably attaching the band 12 to a corresponding member in the trunk for semi-permanent installation.

In the preferred embodiment, the wide flexible band 12 is approximately 4–6 inches wide and about 4–6 inches long. Such a length is desirable to prevent the device from becoming loose during operation.

The animal FIG. 10 is made in the conventional manner that plush figures are made, having an outer fabric 16 filled with soft filling 24.

Figure 3:
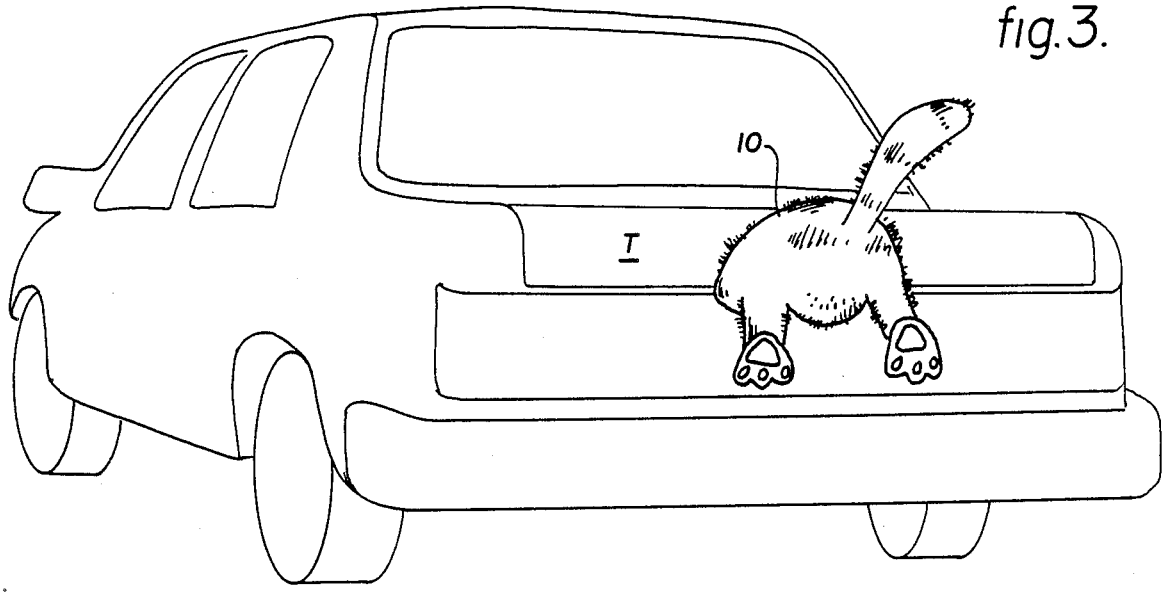
FIG. 3 is a side view of the present invention illustrating the device as within a trunk of a car.
Figure 4:
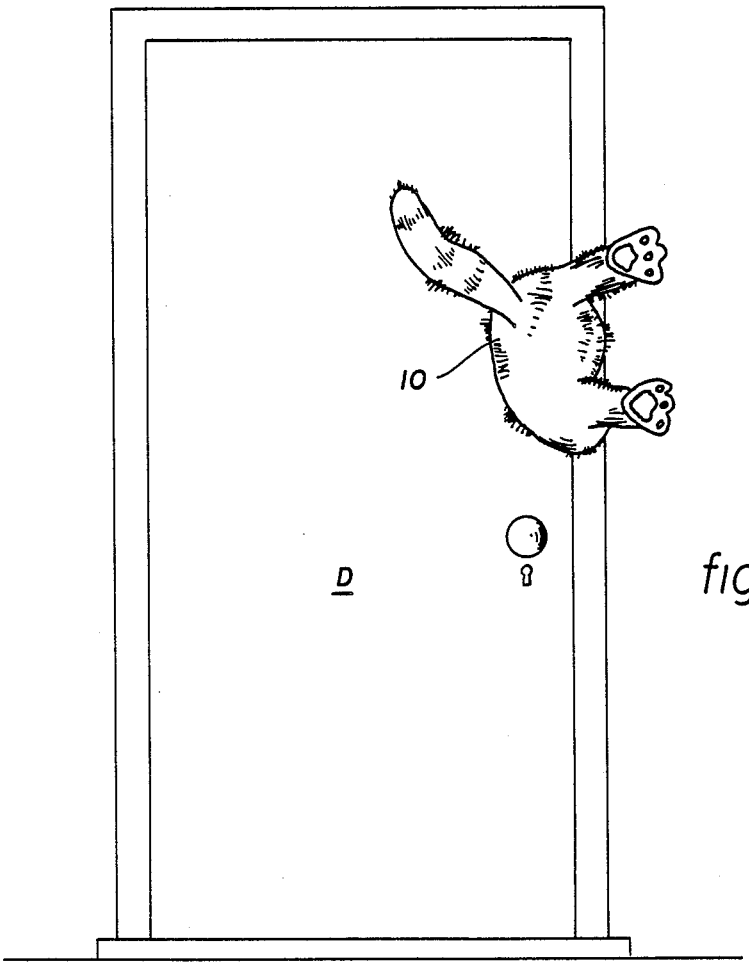
FIG. 4 is a side view of the present invention illustrating the device in the closed door.

During use of the invention, the user would place the hollow tubular member 20 within an enclosure, such as in a trunk of a car as shown in FIG. 3 or on one side of the door D such as shown in FIG. 4, and the trunk or door closed over the wide band 12. The visual appearance from outside the car trunk or door will therefore be that half o a cat or other object having been squashed by the door of the trunk.

If a semi permanent attachment is desired, one half of a Velcro devise is attached to the inside of the trunk, and the other half of the Velcro attached to the wide band. The device would be left in place and would merely be flipped out of the trunk when it was desired to be visible.

It is possible to use a number of different materials as the retaining means, which would prevent the flexible wide band 12 from sliding between the space between the door. The long hollow tubing is desirable because it adds weight to the end of the wide member, making it easier to install and at the same time, prevent the fabric from twisting.

While the invention has been described with regards to the preferred embodiment, it is recognized that other variations may be made without departing from the concept of the present invention.

For example, different items, besides cats or other animals may be used. Also, the figure is preferred to be plush for each of manufacture and appearance, but molded on other means may be employed.

It is also possible to use other than flexible materials for the band 12. However, the use of the flexible band permits the material to conform to the door space, and at the same time, withstand the expected pulling on the object.

What I claim is:

1. A novelty device comprising: (a) a portion of a recognizable object having an end that appears to be missing; (b) a flexible band of material having a first end and a second end said first end of said flexible band being attached to said portion of the recognizable object that appears to be missing; (c) a restraining member comprising a tubular member attached to said second end of said flexible band of material.

2. The novelty device of claim 1 in which said tubular member is hollow.

* * * * *